US005122836A

United States Patent [19]

Fujiwara et al.

[11] Patent Number: 5,122,836

[45] Date of Patent: Jun. 16, 1992

[54] ELECTROPHOTOGRAPHIC APPARATUS HAVING A REMOVABLE CARTRIDGE INCLUDING A PHOTOSENSITIVE BODY

[75] Inventors: Mitsugu Fujiwara, Morioka; Makoto Tomoyori, Iwate, both of Japan

[73] Assignee: Alps Electric Co., Ltd., Tokyo, Japan

[21] Appl. No.: 635,745

[22] Filed: Dec. 28, 1990

[30] Foreign Application Priority Data

Jan. 16, 1990 [JP] Japan ..... 2-6960

[51] Int. Cl.[5] ..... G03G 15/00; G03G 15/04

[52] U.S. Cl. ..... 355/212; 346/108; 355/200; 355/232

[58] Field of Search ..... 355/210, 232, 233, 200, 355/212, 211, 237, 238, 202, 218; 346/108, 160

[56] References Cited

U.S. PATENT DOCUMENTS 4,338,615 7/1982 Nelson et al. ..... 346/160
4,511,237 4/1985 Kawata et al. ..... 355/200 X
4,630,919 12/1986 Fantuzzo et al. .
4,703,334 10/1987 Mochimaru et al. ..... 346/160
4,757,332 7/1988 Yuasa ..... 346/160
4,912,563 3/1990 Narita ..... 355/210 X
4,963,928 10/1990 Yoshiura ..... 355/210
4,972,227 11/1990 Onoda et al. ..... 355/210

FOREIGN PATENT DOCUMENTS 0240567 10/1988 Japan ..... 355/218
87/03707 6/1987 World Int. Prop. O. ..... 355/218

*Primary Examiner*—Joan H. Pendegrass
*Assistant Examiner*—Thu Anh Dang
*Attorney, Agent, or Firm*—Guy W. Shoup; David W. Heid

[57] ABSTRACT

The present invention relates to an electrophotographic apparatus, in which an optical writing head is disposed in the neighborhood of a photosensitive body on the inner side thereof. The photosensitive body is located in a cartridge, which can be freely inserted and drawn out with respect to the main body of the apparatus and a guiding member is disposed in the cartridge, which member guides one end portion of the optical writing head, the other end portion of which is held by the main body of the apparatus to effect the positioning of the optical writing head. By constructing it in this way it is possible to effect the exchange operation of the cartridge, in which the photosensitive body is located, without dismounting the optical writing head and no position adjusting work therefor is necessary.

5 Claims, 4 Drawing Sheets

ELECTROPHOTOGRAPHIC APPARATUS HAVING A REMOVABLE CARTRIDGE INCLUDING A PHOTOSENSITIVE BODY

FIELD OF THE INVENTION

The present invention relates to an electrophotographic apparatus, and in particular to an electrophotographic apparatus, in which an optical writing head such as an LED head, etc. is used as means for forming an electrostatic latent image on a photosensitive body and a desired image is formed by developing the latent image thus formed and transferring it to a predetermined sheet.

BACKGROUND OF THE INVENTION

Heretofore an electrophotographic apparatus is known, in which a desired image is formed by forming an electrostatic latent image by means of an optical writing head using an LED, a liquid crystal shutter, EL, etc. on a photosensitive body and by developing this latent image and transferring it to a predetermined sheet.

In such a prior art electrophotographic apparatus there is disposed movably e.g. an endless photosensitive belt and in the neighborhood an on the outer side of this photosensitive belt there are disposed a charger, an LED head acting as the optical writing head and a developer. The electrostatic latent image is formed on the photosensitive belt by making the LED head emit light on the basis of a predetermined printing signal after having made the photosensitive belt writable by means of the charger. The desired image is formed on the sheet by attacking toner to this electrostatic latent image formed on the photosensitive belt by means of the developer to visualize it and by fixing the toner image thus obtained after having transferring it to the predetermined sheet.

Such an electrophotographic apparatus had a problem that, since the LED head is disposed on the outer periphery side of the photosensitive belt, in the case where scratches are produced on the surface of the photosensitive belt by a cleaner, etc., light coming from the LED head is diffused thereby and as the result the resolution of the latent image formed on the photosensitive belt is decreased.

For this reason there is known an electrophotographic apparatus, in which the LED head is disposed on the inner side of the photosensitive belt so that the latent image is formed by irradiating the inner side of the photosensitive belt with light. In such an electrophotographic apparatus, even in the case where scratches, etc. are produced on the surface of the photosensitive belt, the diffusion of the light is prevented and thus it is possible to form an image of high resolution.

However, in the prior art electrophotographic apparatuses described above, since the life of the photosensitive belt is relatively short with respect of the life of other members, it is necessary to exchange the photosensitive belt for every predetermined period. Therefore the photosensitive belt is constructed in the form of a cartridge so that the exchange operation for the photosensitive belt can be effected easily. However, since the LED head is disposed on the inner side of the photosensitive belt, it is necessary to dismount the LED head at the exchange of the photosensitive belt. Therefore not only the exchange operation for the photosensitive belt is extremely complicated, but also an operation for adjusting rigourously the position, where the LED head is mounted, is necessary for every exchange. In addition, it had a problem that it is feared to destroy the LED head at the mounting and dismounting thereof.

OBJECT OF THE INVENTION

The present invention has been done in view of these points and the object thereof is to provide an electrophotographic apparatus, in which a cartridge, in which a photosensitive body is located, can be easily mounted and dismounted without dismounting an optical writing head such as an LED head.

SUMMARY OF THE INVENTION

An electrophotographic apparatus according to the present invention, in which there are disposed a photosensitive body within a main body as well as an optical writing head located in the neighborhood of the photosensitive body on the inner side thereof for forming an electrostatic latent image on the photosensitive body on the basis of an image signal and developing means for developing this electrostatic latent image by using toner together therewith, is characterized in that the photosensitive body is located in a cartridge, which is disposed so as to be freely inserted in an extracted from the main body, and a guiding member is disposed in this cartridge, which guiding member guides one end of the optical writing head, the other end of which is held by the main body, and positions the optical writing head stated above.

According to the present invention, it is possible to mount and dismount easily the cartridge without dismounting the optical writing head by inserting the cartridge in the main body so that the optical writing head is inserted in the head guiding member of the cartridge at inserting it therein, i.e. to effect the exchange operation for the photosensitive body and in addition, the optical writing head is positioned at a predetermined position by the guiding member, as the cartridge is inserted. Therefore the adjustment of the mounting position of the optical writing head is unnecessary.

DETAILED DESCRIPTION

Hereinbelow an embodiment of the present invention will be explained, referring to FIGS. 1 to 5A, 5B and 5C.

Figure 1:
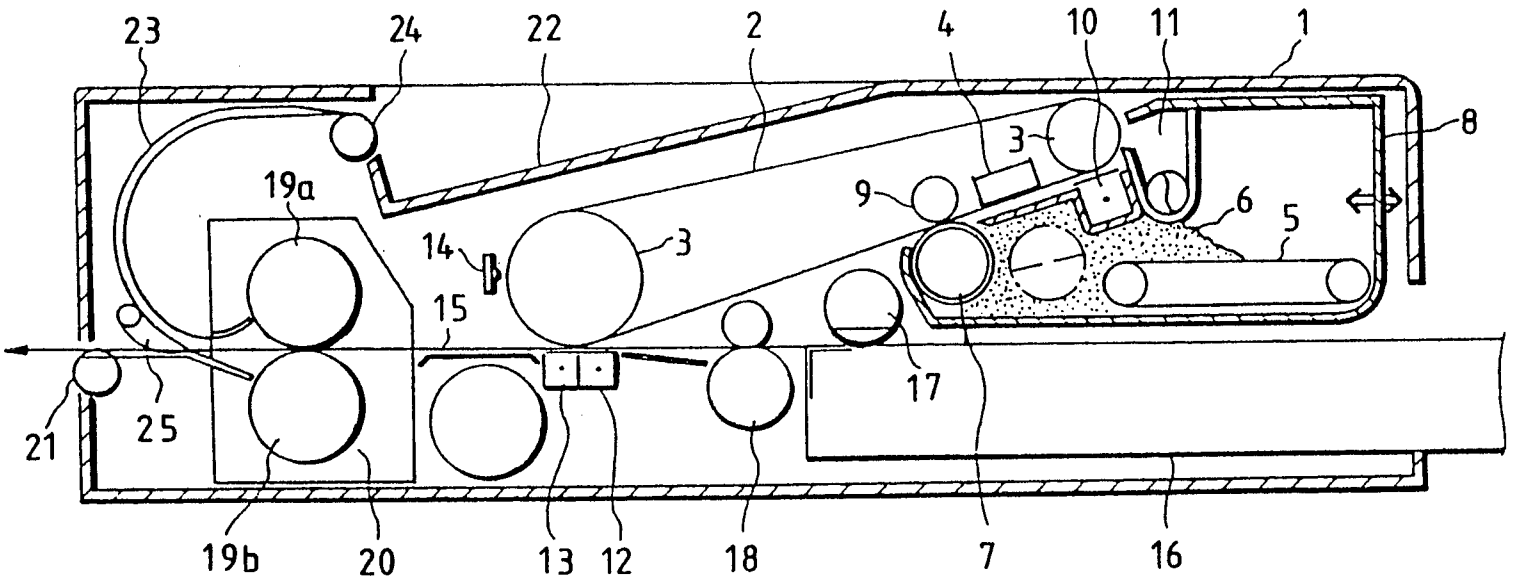
FIG. 1 is a longitudinal cross-sectional view of a whole electrophotographic apparatus, which is an embodiment of the present invention.

FIG. 1 illustrates an embodiment of the electrophotographic apparatus according to the present invention, in which an endless photosensitive belt 2, on the surface of which a photoconductive layer is formed, is disposed in the intention of a box-shaped main body 1 and this photosensitive belt 2 is stretched between a pair of driving rollers 3, 3 disposed in the interior of the main body 1.

On the inner side of the photosensitive belt 2 stated above there is disposed on LED head 4 emitting light on the basis of a predetermined image signal in contact with the inner surface of the photosensitive belt 2. In this way the photosensitive body disposed on the outer side is irradiated with light emitted by the LED head 4 described above through the transparent base material on the inner side of the photosensitive belt 2 so that the desired electrostatic latent image is formed on the photosensitive body.

On the downstream side of the photosensitive belt 2 with respect to the LED head described above there is disposed movably right and left in the figure a developer 8 including a toner attracting roller 7, which makes the electrostatic latent image formed on the photosensitive belt 2 attract toner 6 conveyed by means on a toner conveying belt 5. Further an auxiliary roller 9 is disposed at a position corresponding to the toner attracting roller 7 on the inner side of the photosensitive belt 2. In the present embodiment, at a position corresponding to the developer 8 stated above on the upstream side of the photosensitive belt 2 with respect to the LED head 4 there is disposed a charger 10 in one body with the developer 8. Still further a cleaner 11 is disposed in one body with the developer 11 at a position corresponding to the developer 8 on the upstream side with respect to the charge 10. On the downstream side of the photosensitive belt 2 with respect to the developer 8 there are disposed a transferrer 12 for transferring the toner 6, a peeling charger 13 adjacent to this transferrer 12 and an exposer for removing remaining potential on the photosensitive belt 2 one after another. In the lower part of the main body 1 under the developer 8 a sheet feeding device 16, in which sheets are located, is mounted freely mountably and dismountably. In the neighborhood of this sheet feeding device 16 there are disposed a hopping roller 17 taking out the sheets 15 located in the sheet feeding device 16 one after another and a sheet feeding roller 18 for conveying the sheets 15 between the photosensitive belt 2 and the transferrer 12 stated above. Further, on the downstream side in the conveyance direction of the sheets 15 is disposed a fixer 20 consisting of a head roller 19*a* and a thrusting roller 19*b* and on the downstream side with respect to this fixer 20 is disposed a rear sheet ejecting roller 21 for ejecting the sheet 15 from the rear portion of the main body 1. In addition, an upper sheet ejection tray 22 is formed on the upper surface of the main body 1 and an arc-shaped guiding member 23 for guiding the sheets 15 to the upper sheet ejection tray 22 is disposed on the downstream side with respect to the fixer 20. At the end of this guiding member 23 is disposed an upper sheet ejecting roller 24 for ejecting the sheets 15 to the upper sheet ejection tray 22 and on the downstream side with respect to the fixer 20 is disposed rotatably a commutating lever 25 for commutating the conveyance direction for the sheet 15 either towards the rear sheet ejecting roller 21 or towards the guiding member 23.

FIGS. 2A to 5C illustrate a mechanism for mounting and dismounting the photosensitive belt 2 described above 2, in which a cartridge 26, where the photosensitive belt 2 is located, has a frame body 27, the two extremities of which are open, and a guiding flange 28 is formed at the upper edge of each of the side portions of this frame body 27 so as to protrude therefrom. Supporting frames 29 and 29 are disposed at the two extremities of the frame body 27, respectively, and a head insertion opening 30, through which the LED head 4 is inserted, is formed in each of the supporting frames 29 (refer to FIG. 3B). The two extremity portions of one of he supporting frames 29 are formed so as to protrude outward from the frame body 27 and positioning pins 31 and 31 are formed on the protruding portions of this supporting frame 29, respectively so as to protrude therefrom.

Further, between the supporting frames 29 there are disposed rotatably driving rollers 3, 3 by bearing supporting axes 32 mounted on the two extremity portions of the driving rollers 3 by the supporting frames 29. An engaging groove 33 is formed on the periphery of one extremity portion of the supporting axis 32 of each of the driving roller 3 and a driving gear 34 is mounted on one end portion of one of the driving rollers 3, which gear is linked with a drive transmission gear from a driving device not indicated in the figures.

Furthermore, a head guiding member 35 (refer to FIG. 4) having a U-shaped cross section is mounted on the outer peripheral portion of the head insertion opening 30 described above formed in each of the supporting frame 29 and guiding rails 37, in each of which a tapered guiding groove 36, which is wider on the insertion side for the LED head 4, is formed, are secured to the side surfaces opposite to each other of this head guiding member 35. A positioning plate spring 38 for positioning the LED head 4 by thrusting it downward is secured to the end portion of the head guiding member 35 described above and further a reinforcing member 39 having an L-shaped cross section is mounted between the supporting frames 29.

Figure 5A:
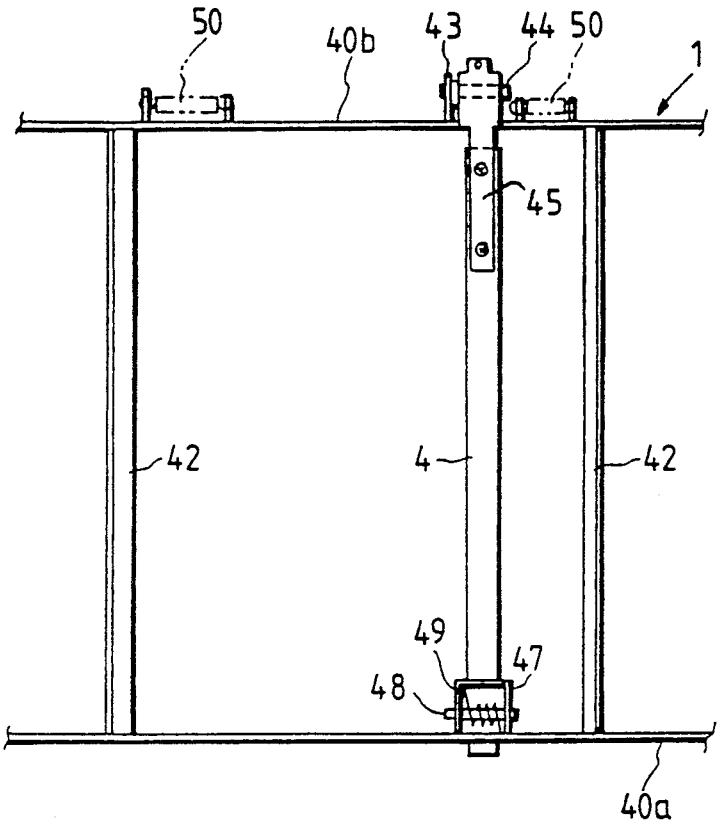
FIGS. 5A, 5B and 5C are a plan view, a side view and a front view illustrating the main body in the state where the cartridge is dismounted therefrom.
Figure 5B:
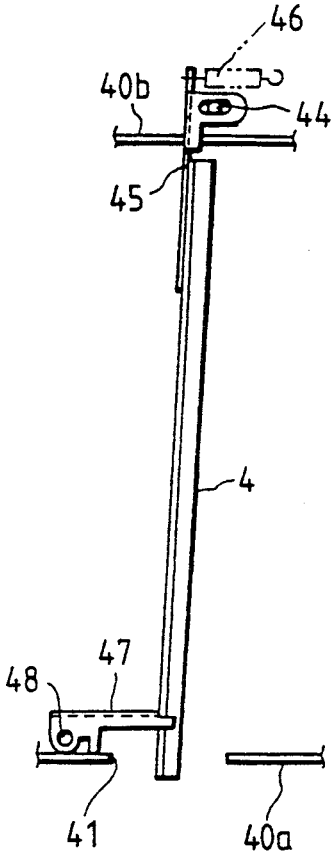
Figure 5C:
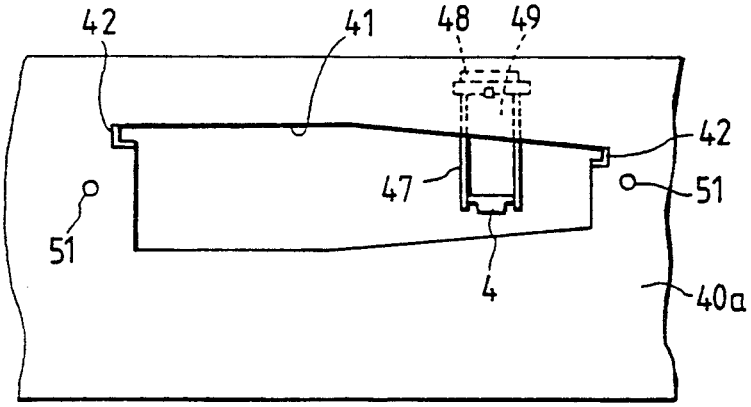

Further, as indicated in FIGS. 5A, 5B and 5C, in one side plate 40*a* of the main body I is formed a cartridge insertion opening 41 for mounting and dismounting the cartridge 26. Between the two side plates 40*a* and 40*b* guiding bars 42 and 42 holding the guiding flange 28 of the frame body 27 of the cartridge 26 are secured to the two extremity portions of the cartridge insertion opening 41 described above. Further a head fixing flange 43 is secured to the outer surface of the other side plate 40*b* and a holding shaft 44 extending parallelly to the side plate 40*b* is secured to this fixing flange 43. A fixing plate 45, whose extremity portion extends from the side plate 40*b*, is mounted pivotably up and downward around the holding shaft 44 thereon. The LED head 4 is secure to the lower surface of the extremity portion of this head fixing plate 45. A head energizing spring 46 is connected with the part of the head fixing plate 45 outside of the holding shaft 44 described above so that the head fixing plate 45 i.e. the LED head 4 is always energized in the direction where it is pivoted upward.

Further a head stopper 47 limiting the upward pivoting operation of the LED head is mounted pivotably up and downward around the holding shaft 48 on the inner surface of the side plate 40*a*, in which the cartridge insertion opening 42 is formed, and a stopper spring 49 energizing the head stopper 47 in the direction, where it is pivoted downward, is mounted on this head stopper. Still further a shaft fixing spring 50 engaged with the engaging groove 33 formed on the supporting shaft 32 of the driving roller 3 of the cartridge 26 to energize downward this supporting shaft 32 is mounted on the side plate 40*b* and a positioning hole 51, with which the positioning pin 31 of the cartridge 26 is engaged, is formed in the side plate 40*a*.

Now the operation of the present embodiment will be explained.

In the case where the cartridge 26 is not loaded in the main body 1, as indicated in FIGS. 5A, 5B and 5C, since the head stopper 47 is pivoted downward by the energizing force of the stopper spring 49, the LED head 4 is pivoted upward by the energizing force of the head energizing spring 46 through the head fixing plate 45 so as to be brought into contact with the extremity portion of the head stopper 47.

Figure 2A:
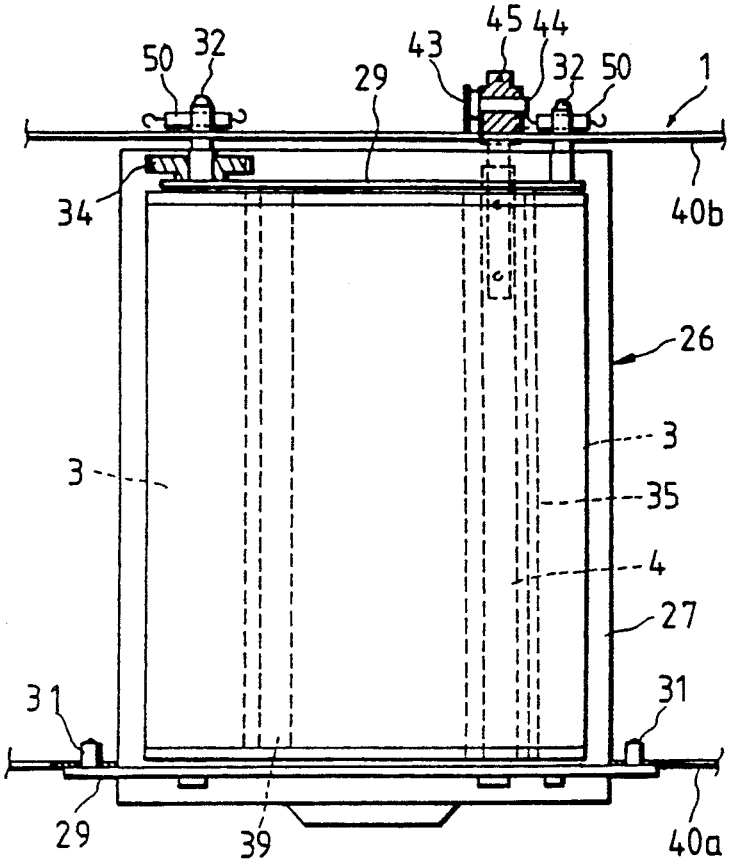
FIGS. 2A, 2B and 2C are a plan view, a side view and a front view, respectively, illustrating a state where the cartridge is mounted in the main body.
Figure 2B:
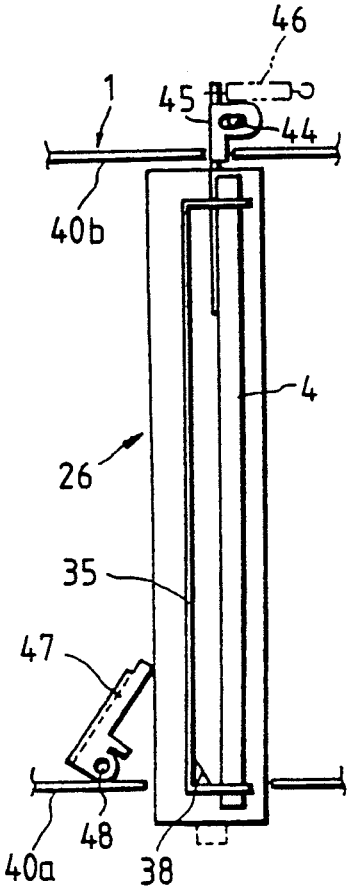
Figure 2C:
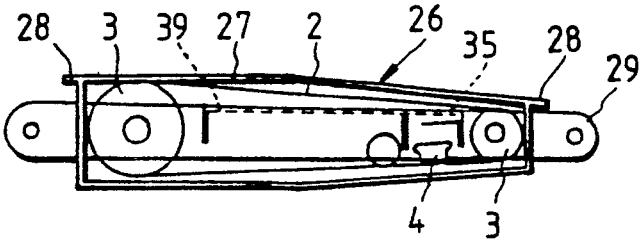
Figure 3:
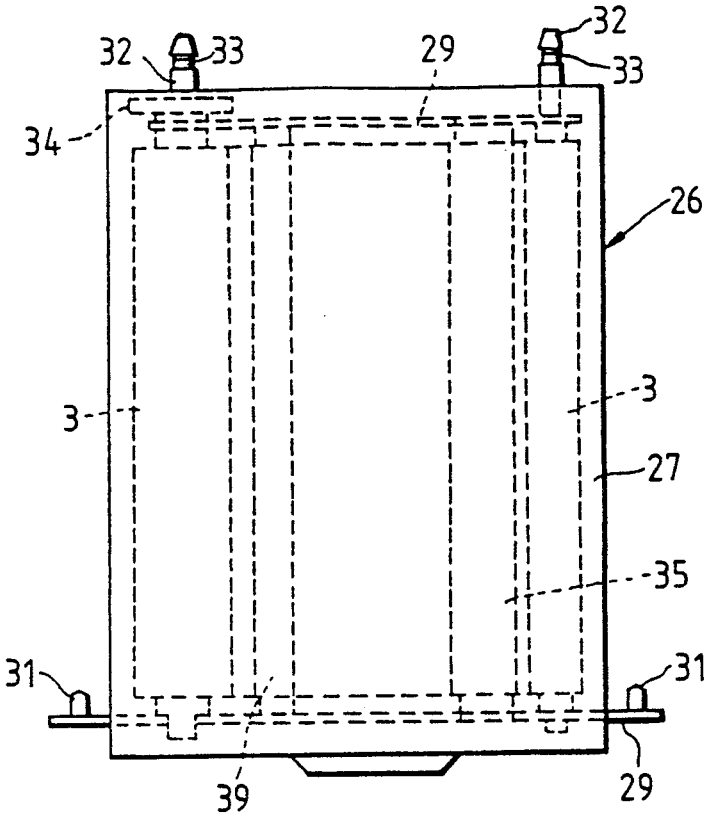
FIGS. 3A and 3B are a plan view and a front view, respectively, illustrating the cartridge.
Figure 3:
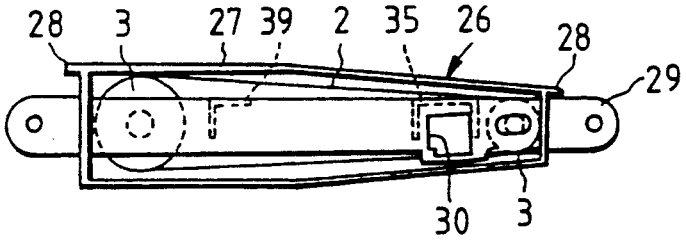
Figure 4:
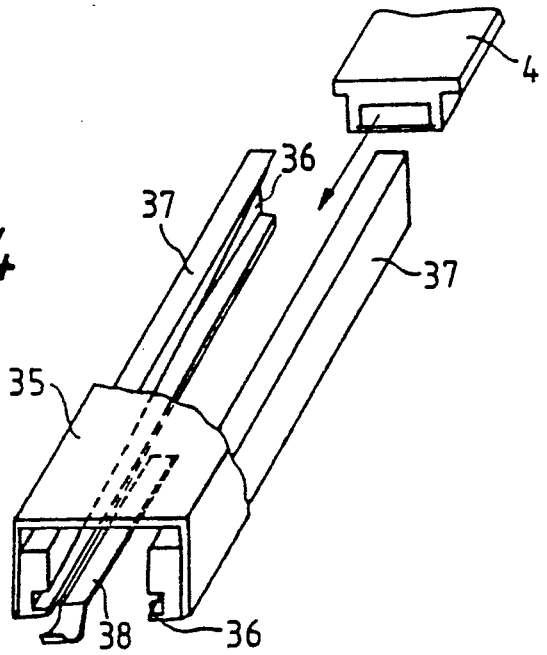
FIG. 4 is a perspective view of the head guiding member.

On the other hand, in the case where the cartridge 26 is loaded in the main body 1, at first, in the state where the developer 8 is moved to the right in FIG. 1, the cartridge 26 is inserted in the cartridge insertion opening 41 so that the guiding flange 28 of the frame body 27 is held by the guiding bar 42 and at the same time the extremity of the LED head 4 is inserted in the portion of the head insertion opening 30 of the cartridge 26. In this way, when the cartridge 26 is inserted in the interior of the main body 1 while being held and guided by the guiding bar 42 described above, the frame body 27 of the cartridge 26 is brought into contact with the head stopper 47 and by inserting the cartridge 26 further, the head stopper 47 is pivoted upward against the energizing force of the stopper spring 49 so as not to hinder the insertion operation of the cartridge 26. Then, when the cartridge 26 is inserted further, the supporting shaft 32 of the cartridge 26 traverses the side plate **40*b* and the engaging groove 33 of this supporting shaft 32 is engaged with the shaft fixing spring 50. By the fact that the positioning pin 31 of the frame is engaged with the positioning hole 51 formed in the side plate 40*a*, the cartridge 26 is loaded in the predetermined position, as indicated in FIGS. 2A, 2B and 2C. At this time, the driving gear 34 is engaged with the drive transferring gear from a driving device not indicated in the figure and in this way the driving roller 3** is driven so as to be rotated by driving this driving device.

On the other hand, as the cartridge 26 is inserted, the LED head 4 is guided downward along the guiding grooves 36 in the guiding rails 37 against the energizing force of the head energizing spring 46. When this LED head 4 is guided up to the end portion of the guiding rails 37, the LED head 4 is thrust downward by the positioning plate spring 38 to be positioned at the predetermined position.

On the contrary, in the case where the cartridge 26 is dismounted, contrarily to the operations described above, when the cartridge 26 is drawn out along the guiding bars 42 by a predetermined amount, by the fact that the contact of the head stopper 47 with the frame body 27 is released, the head stopper 47 is pivoted downward by the energizing force of the stopper spring 49. When the cartridge 26 is drawn out further from the cartridge insertion opening 41 and the LED head 4 is separated from the guiding rail 37, the LED head 4 is pivoted upward by the energizing force of the head energizing spring 46. In this way the LED head 4 is held in the state where it is in contact with the extremity portion of this head stopper 47 and thus it is returned to the initial state.

Further, in the case where a desired image formation is effected, a sheet 15 is taken out from the sheet feeding device 16 by means of the hopping roller 17 and conveyed towards the transferrer 12 by the sheet feeding roller 18. Then, after the photosensitive belt 2 has been turned to the writable state by the charger 10, the LED head 4 is operated on the basis of the predetermined printing signal so that the photosensitive belt 2 is irradiated with light from this LED array from the base material side of the inner peripheral surface to form the electrostatic latent image.

At this time, in the present embodiment, since the LED head 4 is disposed on the inner surface side of the photosensitive belt 2, it is possible to prevent for toner 6 sputtered from the developer 8 to be attached to the LED head 4. In addition, even in the case where scratches are produced in the photoconductive layer on the surface of the photosensitive belt 2 by the cleaner 11, etc. Which are in contact with the surface of the photosensitive belt, no scratches are produced in the inner surface of the photosensitive belt 2, it is possible to prevent for light from the LED head 4 to be diffused.

Then, toner is attached to the electrostatic latent image formed on the photosensitive belt 2 by means of the toner attracting roller 7 in the developer 8 to visualize it and the toner 6 stated above is transferred to the upper surface of the sheet 15 conveyed by the sheet feeding roller 18 by means of the transferrer 12. Thereafter, after the sheet 15 has been peeled from the photosensitive belt 2 by the peeling charger 13, the sheet 15 is conveyed between the heat roller **19*a* and the thrusting roller 19*b* in the fixer 15. The transferred toner image is fixed by making this sheet 15 pass through the fixer 20. Thereafter the sheet 15 is ejected from the rear ejecting roller 21 or the upper ejecting roller 24 to the rear or upper ejecting sheet tray 22**.

On the other hand, the remaining potential on the photosensitive belt 2 is removed by the exposer 14 and remaining toner 6 on the photosensitive belt 2 is eliminated by the clear 11. In this way the photosensitive belt 2 is again in the state, where it can be charged.

Consequently, in the present embodiment, the cartridge 26, in which the photosensitive belt 2 is located, can be mounted and dismounted without dismounting the LED head 4 from the main body of the apparatus and thus the exchange operation for the photosensitive belt 2 can be effected extremely easily. Further, since it is not necessary to dismount the LED head 4, it is possible to prevent damage of the LED head 4 at the exchange of the cartridge 24. In addition, since the LED head 4 can be positioned by the guiding rails 37, no position adjusting work is necessary for the LED head 4.

The present invention is not restricted to the embodiment described above, but it can be modified at need.

As explained above, by the electrophotographic apparatus according to the present invention, it is possible to mount and dismount the cartridge, in which the photosensitive belt is located, without dismounting the light emitting head, which facilitates extremely the exchange operation for the photosensitive belt. Further, since it is unnecessary to dismount the optical writing head at the exchange of the cartridge, it is possible to prevent damage of the optical writing head at the exchange of the cartridge. Further, since it is possible to position the optical writing head by using the guiding member, an effect can be obtained that no position adjustment is necessary for the optical writing head, etc.

What is claimed is:

1. An electrophotographic apparatus having a main compartment which comprises:

a photosensitive body disposed in a removable cartridge;

an optical writing head for forming an electrostatic latent image on said photosensitive body, said optical writing head having a movable end portion and a stationary end portion fixedly held by said main compartment and being disposed adjacent to an inner side of said photosensitive body; and developing means for developing said electrostatic latent image by using toner, wherein the removable cartridge is disposed in said main compartment so as to be freely inserted and withdrawn from said main compartment, the cartridge comprising;

a guiding member which guides said movable end portion of said optical writing head as the cartridge is inserted, to effect a predetermined position of said optical writing head adjacent to said inner side of said photosensitive body when the cartridge is fully inserted.

2. An electrophotographic apparatus according to claim 1, wherein said photosensitive body is a photosensitive belt.

3. An electrophotographic apparatus according to claim 1, wherein a guiding groove for guiding said optical writing head into position is formed in said guiding member.

4. An electrophotographic apparatus according to claim 1 further comprising: an elastic member, which energizes the movable end portion of said optical writing head into position and is disposed at the movable end portion of said guiding member.

5. An electrophotographic apparatus according to claim 1, wherein said developing means is movable between an active position, where it can act on said photosensitive body, and a non active position, where said cartridge is withdrawn from said main compartment.

* * * * *